US009789376B1

(12) United States Patent
Henry

(10) Patent No.: US 9,789,376 B1
(45) **Date of Patent: *Oct. 17, 2017**

(54) ADJUSTABLE STRAPS FOR AN INFLATABLE DEVICE

(71) Applicant: Andre Lee Lewis Henry, Brooklyn, NY (US)

(72) Inventor: Andre Lee Lewis Henry, Brooklyn, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/817,277

(22) Filed: Aug. 4, 2015

Related U.S. Application Data

(60) Provisional application No. 62/032,984, filed on Aug. 4, 2014.

(51) Int. Cl.
*A63B 69/20* (2006.01)

(52) U.S. Cl.
CPC ..... *A63B 69/205* (2013.01)

(58) Field of Classification Search
CPC ... A63B 69/004; A63B 69/201; A63B 69/206; A63B 69/20; A63B 69/205; A63B 2244/102; A63B 2069/0008; A63B 21/02; A63B 21/04; A63B 69/203; A63B 2210/50; A63B 2071/026; A63B 2225/093; A63B 2225/09; A63B 71/023; A63B 2071/0063; A63B 69/24; A63B 43/007
USPC ..... 482/83–90
See application file for complete search history.

(56) References Cited

U.S. PATENT DOCUMENTS

| | | | | |
|---|---|---|---|---|
| 1,329,559 | A | 2/1920 | Tesla | |
| 2,295,804 | A | 11/1942 | Olson | |
| 2,734,308 | A | 2/1956 | Gassaway | |
| 2,804,085 | A | 8/1957 | Di Gembeardino et al. | |
| 2,824,570 | A | 2/1958 | Silverman et al. | |
| 3,042,404 | A * | 7/1962 | Masters | A63B 69/0086 473/424 |
| 3,220,729 | A | 11/1965 | Whittington | |
| 3,979,094 | A | 9/1976 | DeWitt | |
| 4,208,048 | A * | 6/1980 | Winterbottom | A63B 69/32 482/84 |
| 4,345,755 | A * | 8/1982 | Eidson | A63B 69/201 482/86 |
| 4,434,980 | A * | 3/1984 | Babineaux | A63B 69/20 482/86 |
| 4,749,185 | A * | 6/1988 | Spears | A63B 69/206 482/89 |
| 5,083,581 | A | 1/1992 | Jaw | |
| 5,098,095 | A | 3/1992 | Weiss | |
| 5,265,636 | A | 11/1993 | Reed | |
| 5,328,425 | A * | 7/1994 | Knighton | A63B 69/201 482/86 |
| 5,915,407 | A | 6/1999 | West | |
| 6,234,940 | B1 * | 5/2001 | Fotsis | A63B 69/201 482/83 |
| 6,375,600 | B1 * | 4/2002 | Mallette | A63B 69/205 482/83 |
| 7,993,248 | B1 * | 8/2011 | Rasmussen | A61H 3/008 482/69 |
| 9,038,652 | B1 | 5/2015 | Henry | |
| 2002/0010057 | A1 * | 1/2002 | Bouvier | A63B 69/201 482/86 |

(Continued)

*Primary Examiner* — Andrew S Lo
(74) *Attorney, Agent, or Firm* — Michael D. Eisenberg

(57) ABSTRACT

A boxing, kickboxing or martial arts bag such as a slip ball or double end bag including a swivel bearing adjustable strap.

14 Claims, 11 Drawing Sheets

(56) References Cited

U.S. PATENT DOCUMENTS

| | | | | |
|---|---|---|---|---|
| 2002/0086776 | A1* | 7/2002 | Fields | A63B 69/201 482/83 |
| 2003/0125168 | A1* | 7/2003 | Hackaday | A63B 69/206 482/89 |
| 2004/0045075 | A1 | 3/2004 | Yan | |
| 2005/0170937 | A1* | 8/2005 | van Straaten | A63B 21/0552 482/124 |
| 2006/0025285 | A1* | 2/2006 | Giusti | A63B 69/201 482/83 |
| 2007/0087912 | A1* | 4/2007 | DeCologero | A63B 69/201 482/86 |
| 2009/0223845 | A1* | 9/2009 | Bosma | A45C 7/0045 206/320 |
| 2010/0113235 | A1* | 5/2010 | Calvagne | A63B 7/02 482/143 |
| 2011/0275493 | A1* | 11/2011 | Perez | A61H 1/02 482/91 |
| 2012/0178595 | A1* | 7/2012 | Simpson-Weber | A63B 7/00 482/92 |
| 2012/0289382 | A1* | 11/2012 | Haddad | A63B 69/0024 482/93 |
| 2013/0085045 | A1* | 4/2013 | Chavez | A63B 21/0442 482/93 |
| 2013/0178314 | A1 | 7/2013 | Raimonda | |
| 2014/0080687 | A1* | 3/2014 | Stuef | A63B 21/04 482/129 |
| 2016/0095420 | A1* | 4/2016 | Moreau | A45F 5/00 248/341 |
| 2016/0095421 | A1* | 4/2016 | Moreau | A45F 5/00 248/341 |

* cited by examiner

ADJUSTABLE STRAPS FOR AN INFLATABLE DEVICE

CROSS-REFERENCES TO RELATED APPLICATIONS

The present application claims priority from U.S. Provisional Application Ser. No. 62/032,984 filed on Aug. 4, 2014 in the United States Patent and Trademark office, which is hereby incorporated by reference in its entirety.

TECHNICAL FIELD

The present invention, in some embodiments thereof, related to boxing, kickboxing and martial arts equipment and, more particularly, to an adjustable strap mechanism for exercise bags and balls as slip ball, double end bag or the like.

INTRODUCTION

In order to adjust conventional double end bags and slip balls, the user disconnects either the double end bag or slip ball, makes several knots in the rubber cord and then reconnects it, in order to see if the object has been adjusted or not. If the object still isn't the right height, the process has to be done repeatedly until the right height is reached.

Moreover, the tension in the core or band controls the elasticity. Variations and elasticity alter the timing and rhythm and movement of the bag or ball when it is being struck by the boxer/user. A bag or ball may move too little or too much depending on the tension in the cord or band, especially since each individual may wish to train with different tension levels depending on desired level or type of practice.

Therefore, embodiments of the present invention include a method for adjusting slip balls and double end bags or the like.

BRIEF SUMMARY OF EMBODIMENTS OF THE INVENTION

An embodiment of the present invention creates a dynamic training exercise device by accommodating people of different heights, people who want to train at different heights, and people who need different levels of attention for training purposes, rather than a one-size-fits-all approach, embodiments of the present invention allow every user to change the device to suit their specific needs. Additionally, an embodiment of the present invention provides dynamic elements in a way that is easier to use, quicker, and far more accurate than using knots. The inventive features also allow the same device to be installed in many different environments because that adjustability allows the device to function well in buildings with different level ceilings.

In an embodiment, the adjustable strap mechanism is connected directly to the inflatable instrument (exercise bags and balls such as a slip ball, double end bag or the like) by the strap member of the adjustable strap mechanism. The entire assembly, including the adjustable strap mechanism in the inflatable instrument, may hereinafter be collectively referred to as the inflatable device.

In another embodiment, the adjustable strap mechanism is connected to the inflatable instrument by a swivel bearing mechanism.

In a further embodiment, the adjustable strap mechanism is connected to the inflatable instrument by lobster clasp which is a fastener that is held closely by a spring.

Other features and aspects of the invention will become apparent from the following detailed description, taken in conjunction with the accompanying drawings, which illustrate, by way of example, the features in accordance with embodiments of the invention. The summary is not intended to limit the scope of invention, which is defined solely by the claims attached hereto.

BRIEF DESCRIPTION OF THE DRAWINGS

The present invention, in accordance with one or more various environments, as described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

DETAILED DESCRIPTION OF THE EMBODIMENTS OF THE INVENTION

Figure 1:
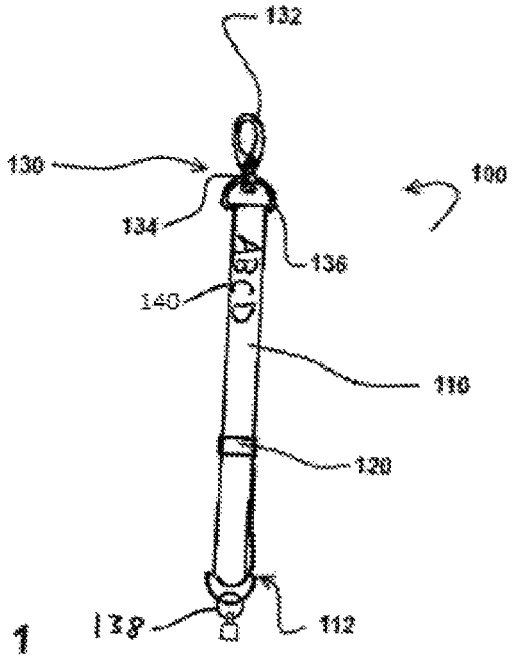
FIG. 1 is a schematic illustration of an embodiment of the adjustable strap mechanism.

From time-to-time, the present invention is described herein in terms of illustrative environments. Description in terms of these environments is provided to allow the various features and embodiments of the invention to be portrayed in the context of an illustrative application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Before describing aspects of the present invention, elements illustrated in the drawings will be now listed along with the corresponding reference numerals:

100 adjustable strap mechanism
110 strap member;
112 bend;
120 moveable clasp;
132 lobster clasp;
134 channel;
136 d-ring;
200 slip ball;
210 slip ball strap;
14 internal pressure release valve;
16 speed bag carcass;
10 speed bag; 12 internal mechanism assembly; 18 cap; 20 groove of cap; 22 retractable mechanism; 24 sleeve; 26 primary one way valve mechanism; 28 outer tube; 30 blockage of air flow; 32 double end bag; 34 double end bag and stability ball carcass; 36 stability ball; 38 secondary one way valve mechanism; 40 conduit.

Broadly, an embodiment of the present invention provides an inflatable instrument such as an exercise bag or ball such as a boxing bag, slip ball, speed bag and double end bag with an adjustable strap mechanism.

More particularly, an embodiment of the invention related to inflatable exercise instruments (e.g., double end bags, slip balls or the like) that have an adjustable strap mechanism that is connected to the inflatable instrument in order to achieve a desired height or tension.

Figure 2:
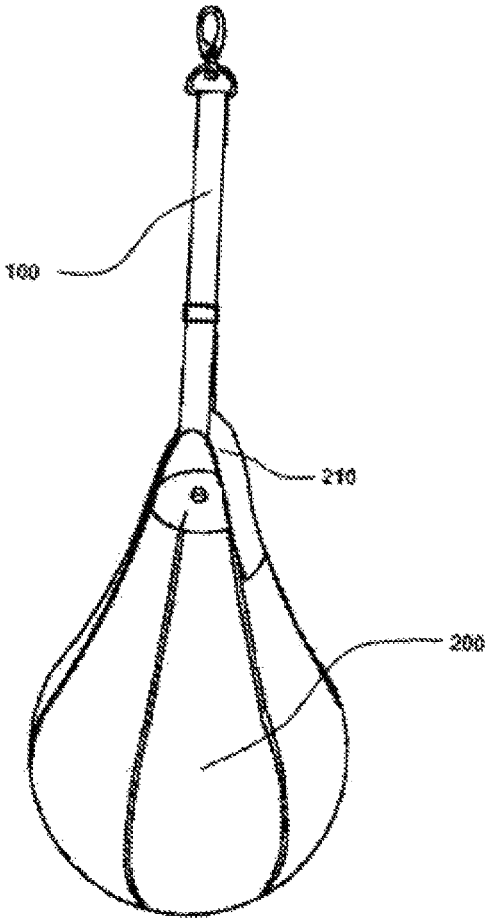
FIG. 2 is a perspective view of a slip ball according to an embodiment of the present invention.
Figure 3:
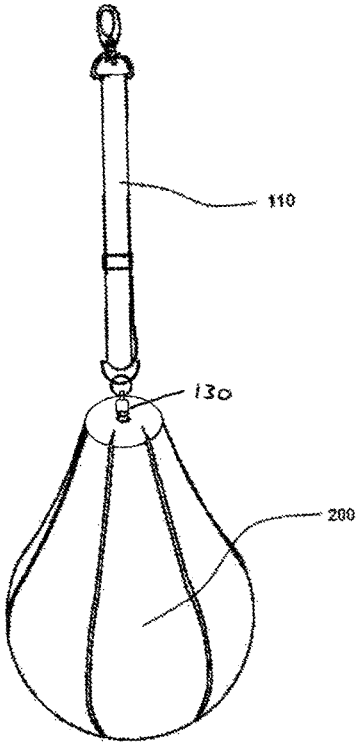
FIG. 3 is a perspective view of a slip ball according to an embodiment of the present invention.
Figure 4:
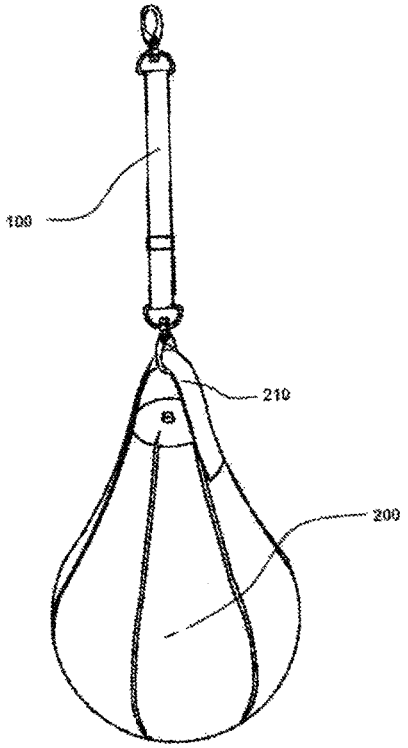
FIG. 4 is a perspective view of a slip ball according to an embodiment of the present invention.
Figure 5:
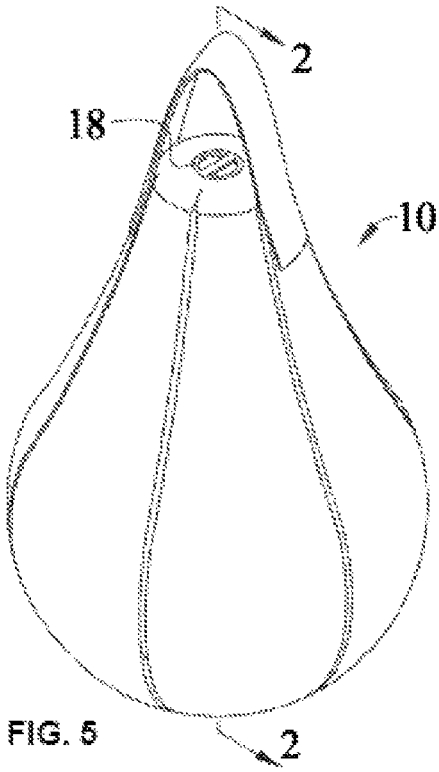
FIG. 5 is a perspective view of an exercise bag according to some embodiments of the present invention.
Figure 6:
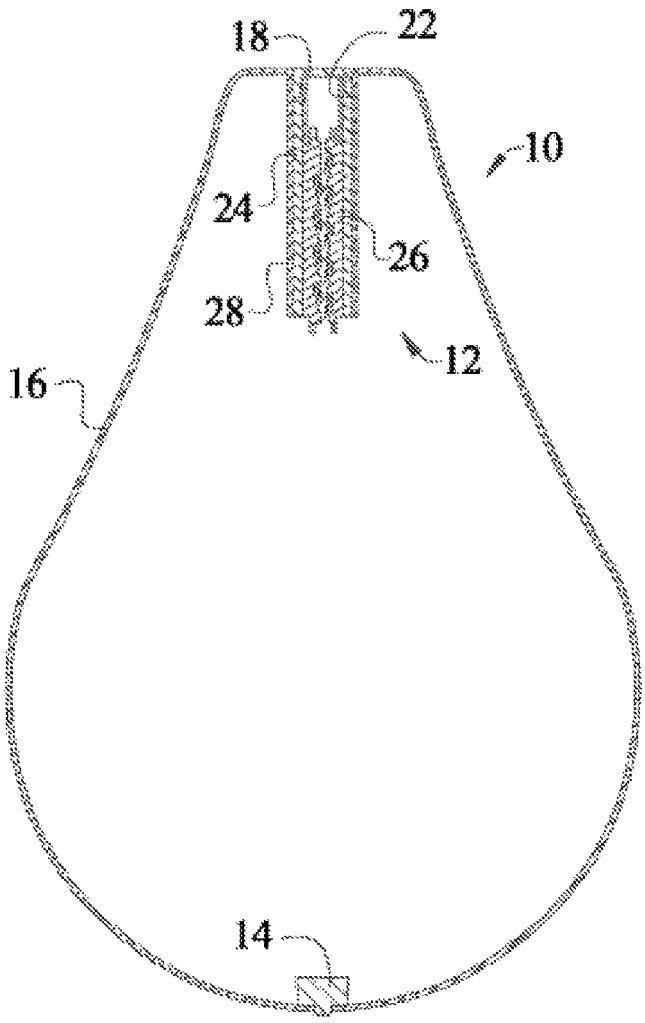
FIG. 6 is a cross sectional view of the exercise bag of FIG. 5.
Figure 7:
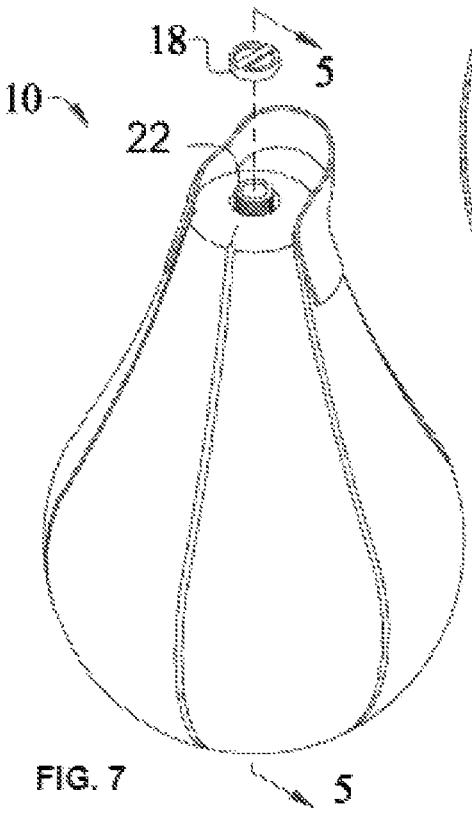
FIG. 7 is a partially exploded perspective view of the exercise bag of FIG. 5, showing a retractable mechanism protruding out of the opening and having a cap remove.
Figure 8:
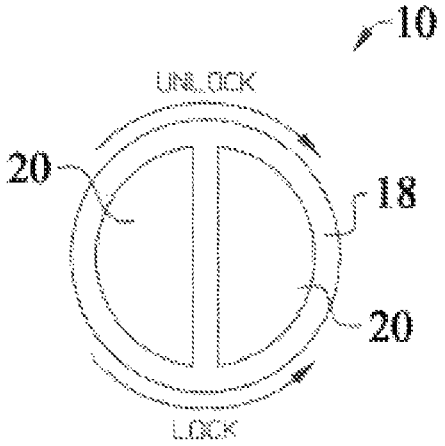
FIG. 8 is a top view of the cap of the exercise bag of FIGS. 5-7.

Referring now to FIG. 1, an adjustable strap mechanism is illustrated in FIGS. 2 through 4, adjustable strap mechanisms are illustrated attached to a slip ball 200 or any other kind of inflatable instrument that includes at least one adjustable strap mechanism 100.

An embodiment of the adjustable strap mechanism is shown in detail in FIG. 1. The strap 110 may be made of cloth, leather, elastic, synthetic, or any other durable material. The strap may hereinafter be referred to as a strap member and include printed characters 140 on the strap member. The strap will have a bend or fold 112 and a moveable clasp 120, which holds the strap 110 at any point the user wants to create the fold 112 at the desired height. In this embodiment, the adjustable strap member 100 has a swivel bearing mechanism 130 as shown in FIG. 2 for connecting the strap 110 to a fixed point on the inflatable instrument, ceiling or the floor. The strap 100 is connected to a D-ring 136 which is typically a metal right that is shaped like a D and can be used at the end of the strap. The D-ring has a channel 134 that houses a pin region of a lobster clasp 132 as in FIG. 4. This allows the bag, including the instance of a slip ball as shown in FIG. 2, the ability to spin without twisting the strap, since the ball bearing structure will allow the ball to move in 360 degrees and not disturb the strap. In another embodiment, the at least one adjustable strap mechanism further comprises a swivel bearing mechanism, the swivel bearing mechanism comprising a spindle end 138 attached to a D-ring and at least one end comprising a lobster clasp. Other embodiments may replace the swivel bearing mechanism with any system that connects the adjustable strap member 100 to a fixed point as shown in FIG. 2.

An embodiment of the present invention provides an inflatable device (e.g., an exercise ball such as a stability ball, fitness ball, body ball (or the like) or an exercise bag such as a boxing bag, slip ball, speed bag and double end bag) with a self-contained internal inflation mechanism. The internal mechanism is intended to allow a user to drive or blow air into the inflatable device without the need for a separate inflation needle being inserted directly into the inflatable device.

The inflatable device includes a carcass 16 having an opening and an internal air intake mechanism assembly 12. The carcass defines a surface of the inflatable device and surrounds an inner volume of the device, and having an opening. The internal air intake mechanism assembly 12 includes a primary one way valve mechanism 26. In a variant, the primary one way valve mechanism 26 is joined to carcass to cover the opening on the carcass 16 of the inflatable device. The primary one way valve mechanism 26 enables air to be directed into the inner volume of the inflatable device from the environment external to the inflatable device, while preventing or limiting air flow from the inner volume into the external environment. The primary valve mechanism 26 may be flush with the surface of the carcass, or may protrude therefrom into the external environment.

The primary valve mechanism 26 may include any kind of one-way valve, such as a Tesla valve or a duckbill valve, for example.

In an embodiment, the inflatable device includes an outer tube 28 integral with the carcass and extending into the device's inner volume from the opening. Thus, the outer tube 28 has an outer opening on the surface of the inflatable device and an inner opening inside the inflatable device. The outer opening of the tube 28 corresponds to the opening of the carcass. Via the outer tube 28, the inner volume of the device is in fluid communication with an environment external to the device. The primary valve mechanism 26 is sealingly joined to the inner surface of the outer tube 28.

Figure 10:
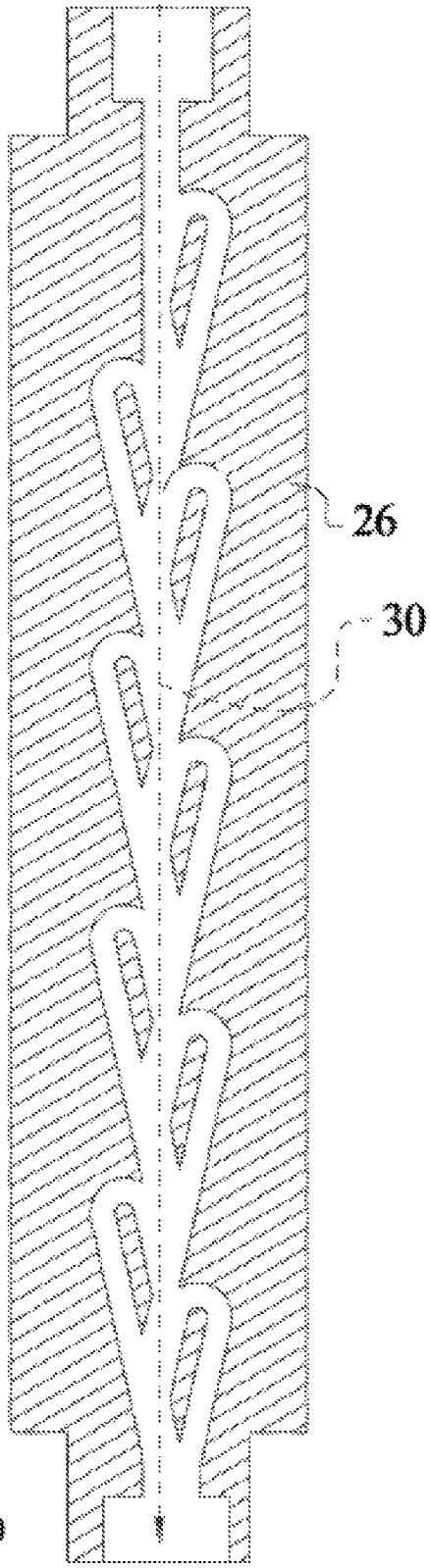
FIG. 10 is a detailed cross sectional view of a one-way valve, illustrating air flow into the exercise bag of FIG. 5.
Figure 11:
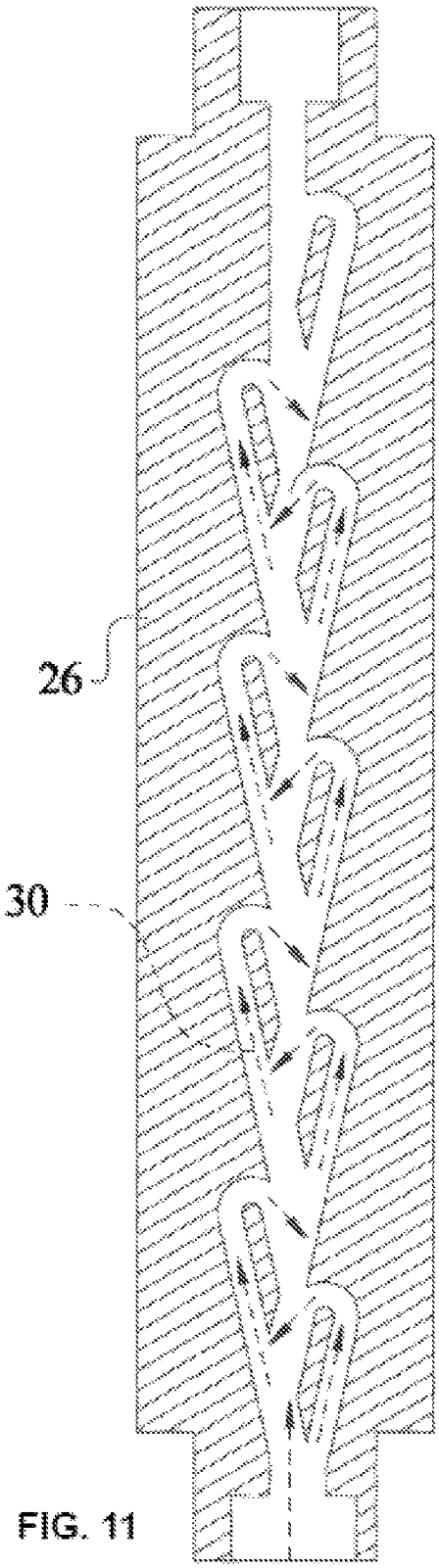
FIG. 11 is a detailed cross sectional view of the one-way valve, illustrating air flow into the exercise bag of FIG. 5.
Figure 12:
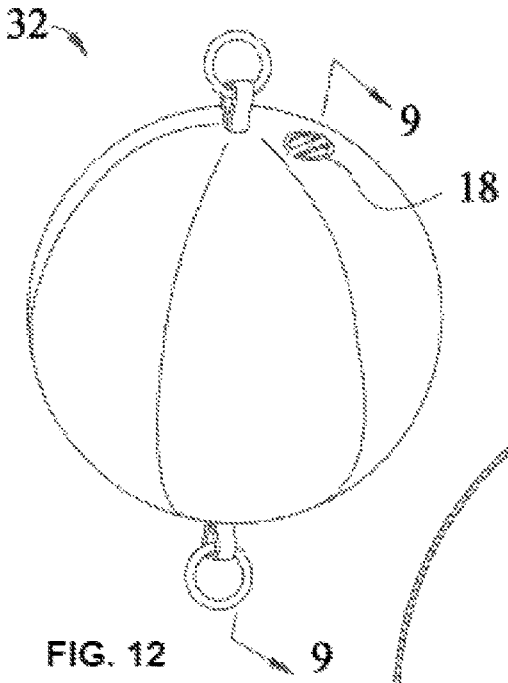
FIG. 12 is a perspective view of a double end bag according to an exemplary embodiment of the present invention.
Figure 13:
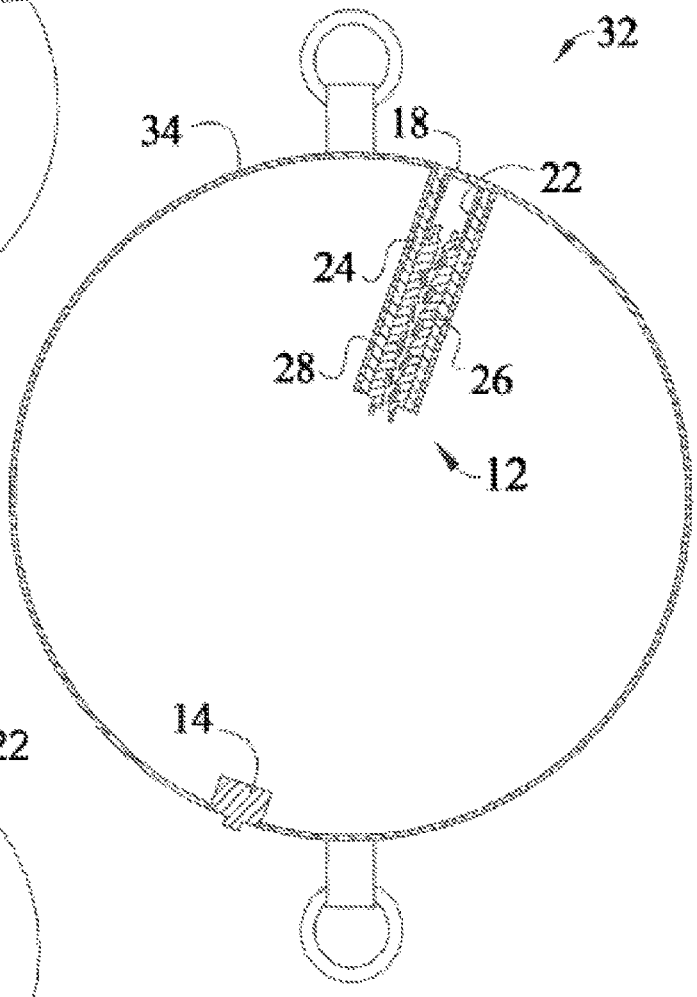
FIG. 13 is a cross sectional view of the double end bag of FIG. 12.
Figure 14:
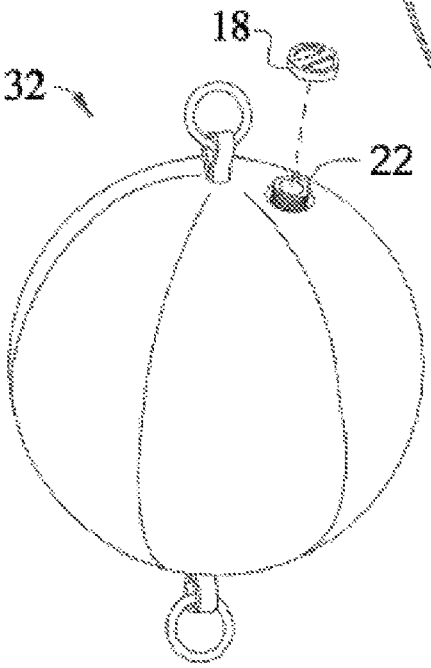
FIG. 14 is a partially exploded perspective view of the double end bag of FIG. 12, showing a cap removed.
Figure 15:
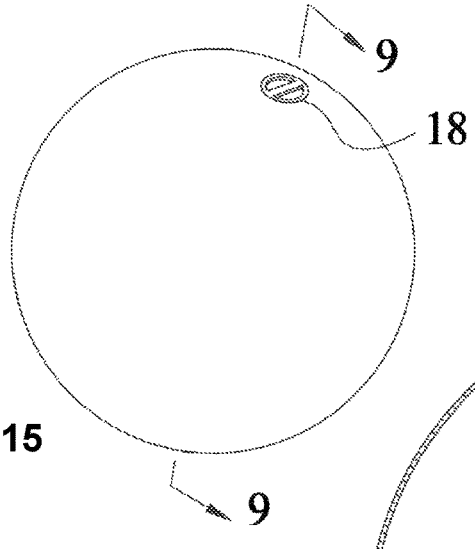
FIG. 15 is a perspective view of a stability ball according to an exemplary embodiment of the present invention.
Figure 16:
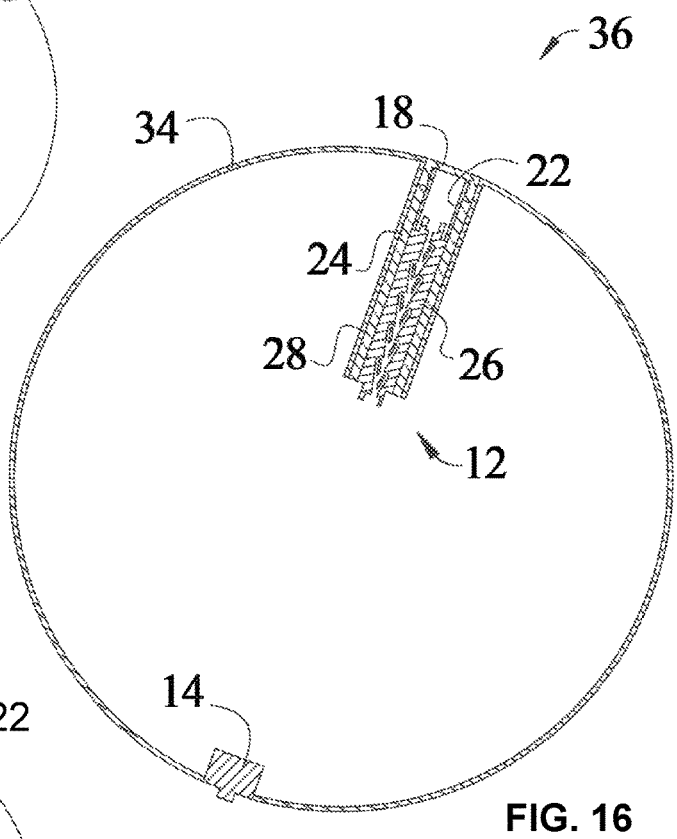
FIG. 16 is a cross sectional view of the stability ball of FIG. 15.
Figure 17:
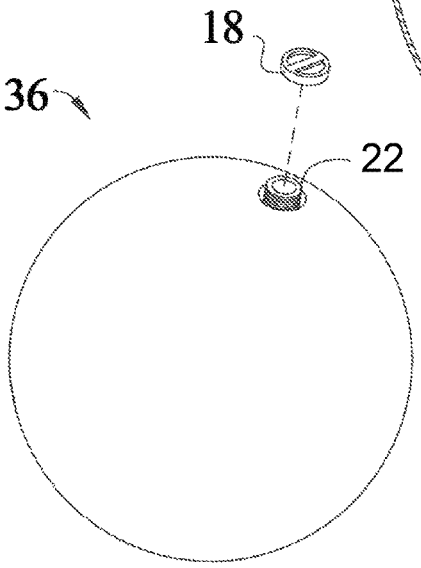
FIG. 17 is a partially exploded perspective view of FIG. 15 showing cap removed.
Figure 18:
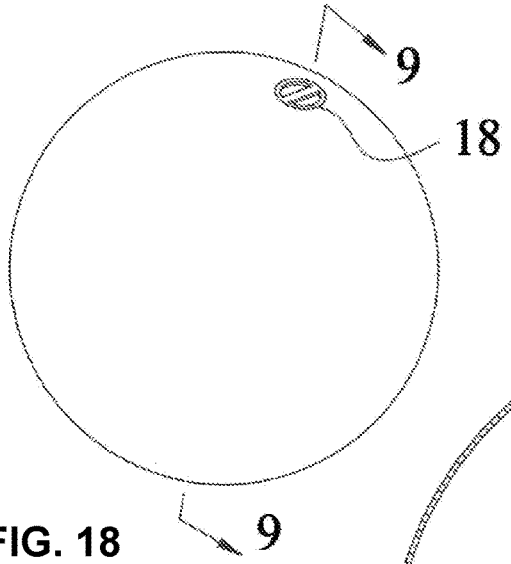
FIGS. 18-20 illustrate an inflatable exercise ball of the present invention, in which the one-way valve is joined to a secondary valve.
Figure 19:
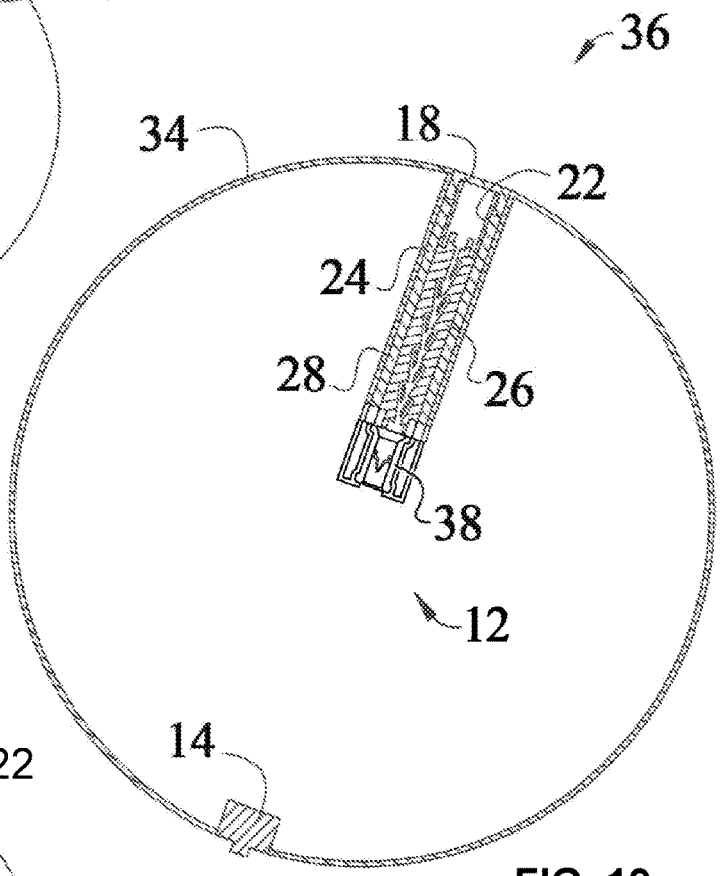
Figure 20:
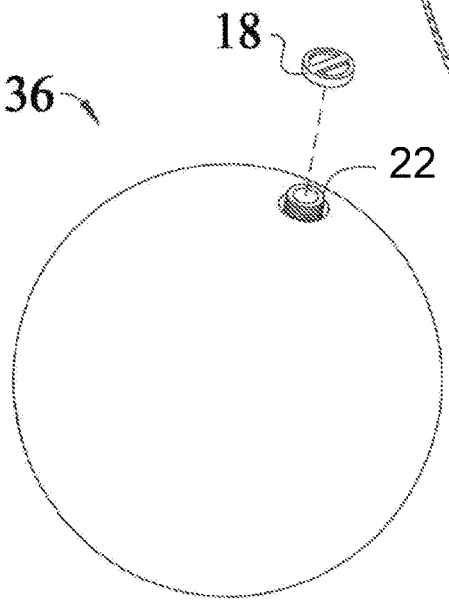
Figure 21:
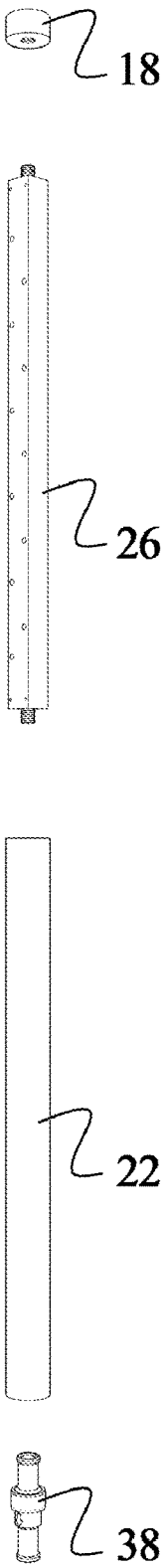
FIG. 21 is a perspective drawing illustrating an example of the connection between the primary one way valve, the retractable mechanism and the secondary one way valve of FIGS. 18-20.
Figure 22:
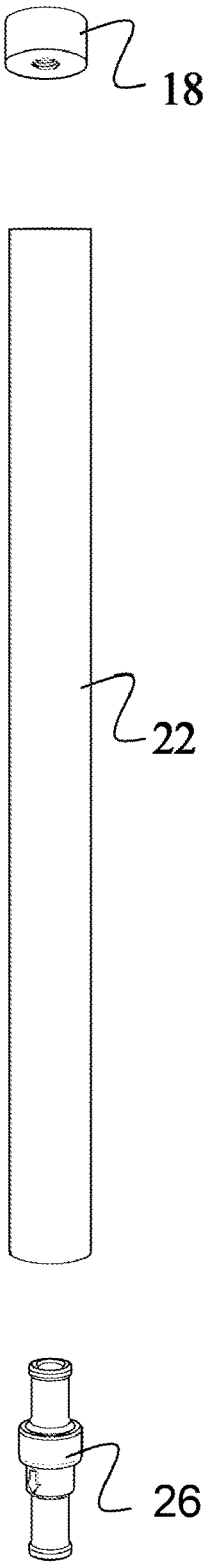
FIG. 22 is a perspective drawing illustrating an example of a connection between the retractable mechanism and the primary one way valve, where the primary one way valve is a duckbill valve.

The air intake mechanism assembly 12 may include a sleeve 24 lining an inner surface of the outer tube 28. The primary one way valve mechanism 26 is fitted into the outer tube 28 and held in position by the sleeve 24. The primary one way valve mechanism may include any known type of one way valve. In some embodiments of the present invention, the primary valve mechanism 26 includes a sealing material having a cavity which opens to the inner volume of the device and to the environment external to the device. The sealing material may be made of rubber or a water proof material, and is configured to block airflow 30 from leaving primary the device via the one way valve mechanism 26 (see FIG. 11). When the air comes in with sufficient pressure, the only place for the air to go is into the primary one way valve mechanism 26 which allows the air to go through and inflate the exercise inflatable device (see FIG. 10). While in FIGS. 5-17 the primary valve mechanism is shown to be a Tesla valve, FIGS. 22-27 illustrate an example in which the primary valve mechanism 26 is a duckbill valve.

In some embodiments of the present invention, the primary valve mechanism 26 is recessed within the outer tube 28 (or the sleeve 24, if present), leaving a hollow space between the outer opening of the tube and an edge of the primary one way valve mechanism. In a variant, the air intake mechanism assembly 12 further includes a hollow removable attachment that has a first opening facing the primary valve mechanism 26 and a second opening to the external environment. The removable attachment may be joined to the outer tube 28 in order to enable access to the air intake mechanism assembly 12 from outside of the inflatable device. Once access is no longer needed, the removable attachment can be detached from the outer tube 28.

Figure 9:
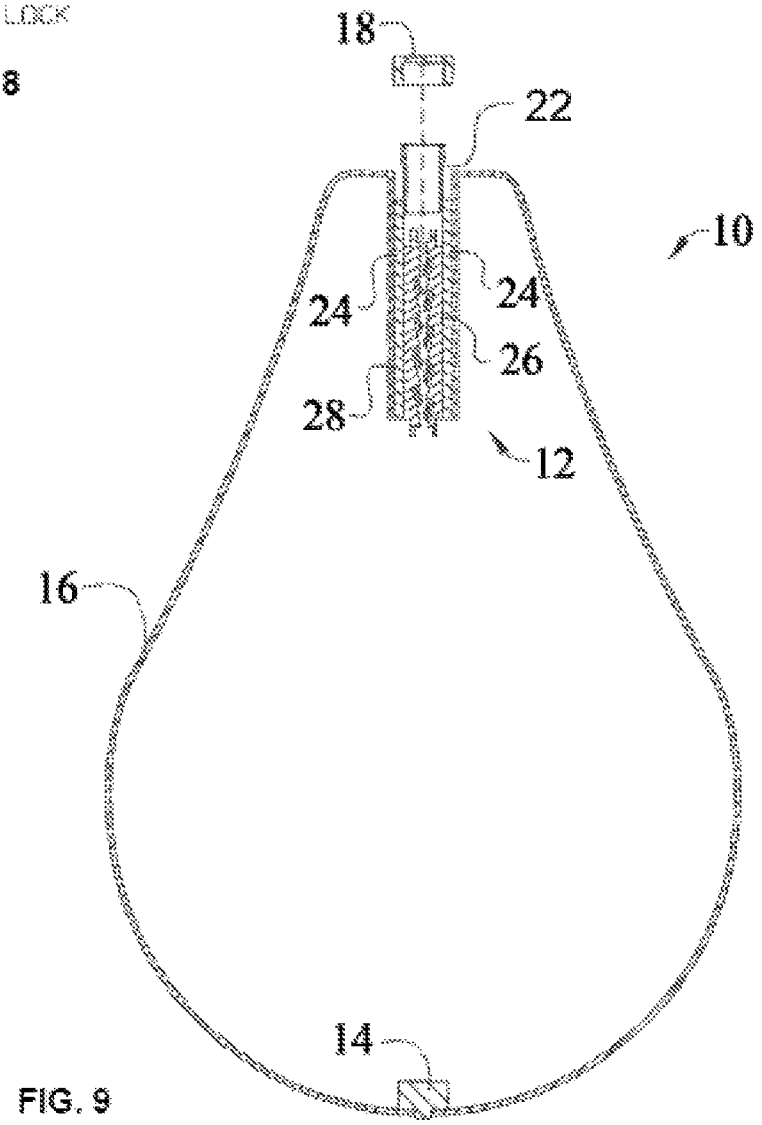
FIG. 9 is a cross sectional view of the exercise bag of FIG. 7.

Optionally the inflatable device includes a retractable mechanism 22 joined to the outer tube 28 (or the sleeve 24, if present) and located between the outer opening of the outer tube and the primary valve mechanism 26. The retractable mechanism 22 is a channel having two openings, and is slidable along the inner surface of the outer tube 28 (or the sleeve 24, if present) to protrude out of the device via the outer tube's outer opening. In this manner, the retractable mechanism 22 can be accessed from outside by the user or by an outer inflation unit (e.g. pump) for driving air via the retractable mechanism 22 and the primary valve mechanism 26 into the inflatable device's inner volume, as shown in FIG. 9.

In a variant, the inflatable device includes a cap 18 adapted to fit on the opening of the carcass (or the outer opening of the tube 28, if the tube is present) and to close the inflatable device, thereby decreasing even more the amount of air leaving the inflatable device. Optionally, when the cap 18 closes the outer opening of the tube 28, the cap 18 is joined to the retractable mechanism 22. Thus, the cap may be pulled outward before being removed to lift the retractable mechanism 22 to protrude out of the inflatable device.

Figure 23:
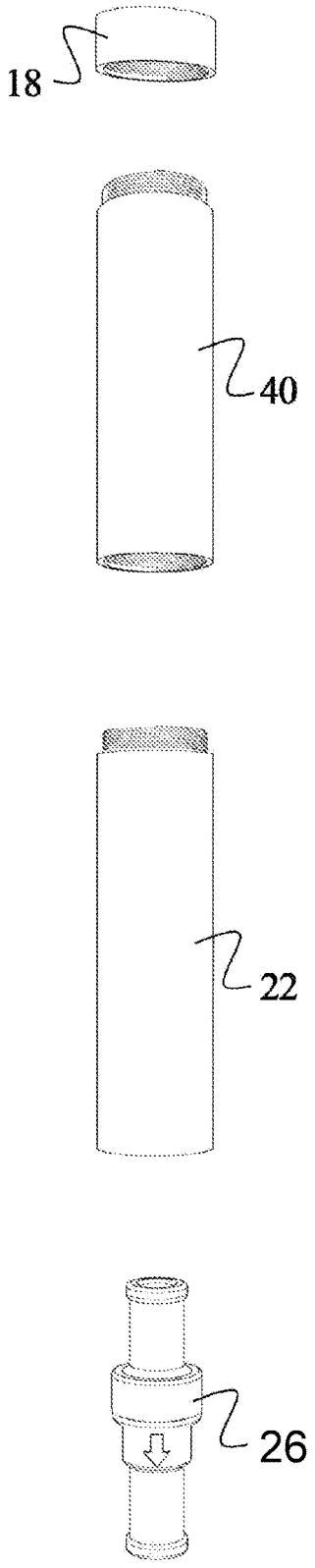
FIG. 23 is a perspective drawing illustrating a conduit joined to the retractable mechanism.
Figure 24:
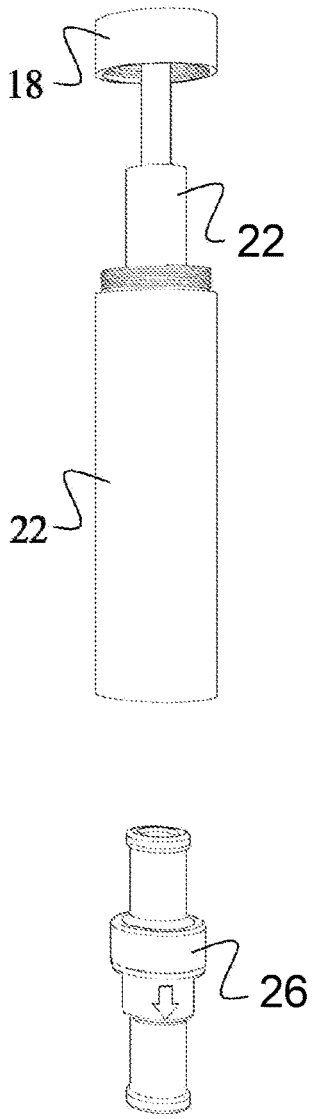
FIG. 24 is a perspective drawing showing the retractable mechanism in its extended mode.
Figure 25:
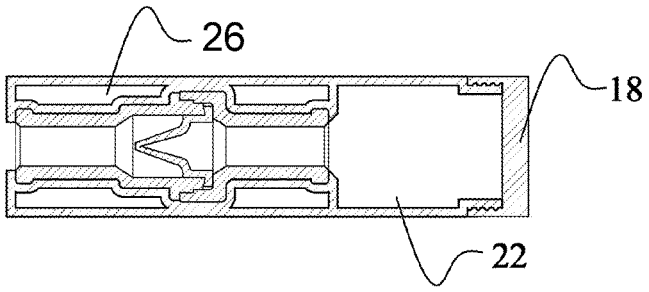
FIG. 25 is a detailed cross sectional view of an internal mechanism assembly which includes a duckbill valve as the primary one way valve and a retractable mechanism in retracted mode, according to some embodiments of the present invention.
Figure 26:
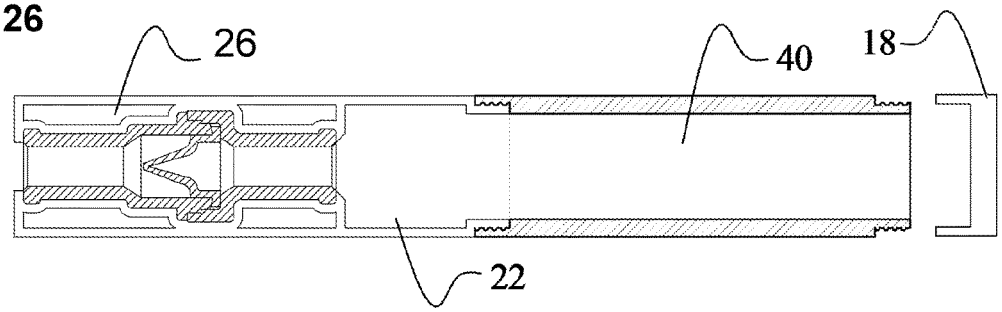
FIG. 26 is a detailed cross sectional view of an embodiment of the present invention in which a conduit is located between the retractable mechanism and the cap.
Figure 27:
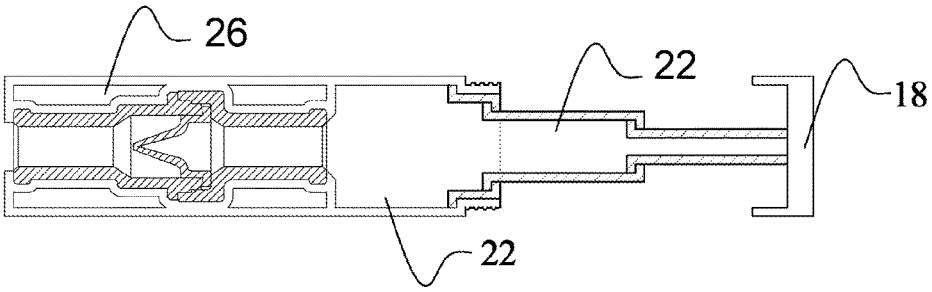
FIG. 27 is a detailed cross sectional view of an internal mechanism assembly which includes a duckbill valve as the primary one way valve and a retractable mechanism in extended mode, according to some embodiments of the present invention.

Optionally, a conduit 40 is joined to the retractable mechanism 22 and the cap 18, as illustrated in FIG. 23 and FIG. 26. The conduit 40 increases the length of the internal air intake mechanism assembly 12, in order to ensure that the internal air intake mechanism assembly 12 fits within a given outer tube. The conduit 40 is removably joinable to retractable mechanism 22 and the cap 18. In this manner, a user may choose whether or not to join the conduit 40 to the retractable mechanism 22 and the cap 18, enabling the user to select the length of the air intake mechanism assembly 12. Optionally, a plurality of conduits 40 having different lengths are provided, to enable the user to vary the length of the air intake mechanism assembly 12 according to the user's need. As mentioned above, the user may pull the cap to extend the retractable mechanism 22. If the conduit is present, the user pulls the cap, and the cap pulls the conduit 40 outward toward the external environment. The retractable mechanism is pulled by the conduit 40 and is extended.

Optionally, the inflatable device includes a counterbalance unit weighed to counterbalance the weight of the internal air intake mechanism assembly 12. The counterbalance unit may be joined to the internal or external surface of the carcass.

The carcass 16 may have a second opening covered by an internal air pressure release valve 14. The internal air pressure release valve 14 is configured to permit air to escape from the second opening if the inflatable device becomes over inflated (i.e. if the air pressure within the inner volume is higher than a threshold pressure). The internal air pressure release valve 14 serve as the counterbalance unit.

As shown in FIGS. 18-21, optionally a secondary one way valve mechanism 38 may be joined to the inner end of the one way valve mechanism 26 to further prevent release of air from the device's inner volume to the environment external to the device. In this manner, the amount of air that is able to be retained inside of the inflatable device may be increased. The secondary valve mechanism 38 may include a valve which is of the same type as the valve of the primary valve mechanism 26, or a valve of a different type. According to a non-limiting example, the primary valve mechanism 26 may include a Tesla valve or any other type of one way valve while the secondary valve mechanism 38 may include a duckbill valve or any other type of one way valve.

Optionally, the air intake mechanism assembly 12 is removably joined to the carcass. In this manner, the air intake mechanism assembly 12 may be joined to the carcass in order to inflate the carcass and keep the carcass inflated for a workout. When the inflatable device is not in use or is to be stored, the air intake mechanism assembly 12 may be removed from the carcass, causing the carcass to deflate.

The inflatable device can take on various forms of construction. Typically, a carcass 16, which is a term used herein to include all the various layers of the inflatable device, includes a rubber bladder for air-retention, a layer coating the bladder and being composed of sheets of nylon or polyester yarn, windings wrapped around the bladder, and an outer rubber layer in order to maximize air retention. In addition, the carcass can also include an additional outer layer of leather or a synthetic which is applied by adhesive and set by pressure during a cold molding process. The windings can be randomly oriented and may be in the form of two or three layers so as to prevent extension of the inflatable device beyond a certain volume, restricting the inflatable device from expanding to any significant extent above its intended size when inflated above its intended pressure. This layer formed by windings, for inflatable devices such as stability balls, slip balls, double end bags and speed bags, is referred to as a lining layer and is usually composed of cotton or polyester cloth that embodies a flexible binder resin such as vinyl or latex rubber.

In another embodiment, the strap member 100 of the adjustable strap mechanism is connected directly to the inflatable instrument.

In another embodiment, the strap member of the adjustable strap mechanism is attached to the inflatable instrument by a loop of elastic material.

In another embodiment, the strap member of the adjustable strap mechanism is attached to the inflatable instrument by a loop of non-elastic material.

In another embodiment, the adjustable strap mechanism is connected to the inflatable instrument by a swivel bearing mechanism 130.

In another embodiment, the at least one adjustable strap mechanism further comprises a front anchor strap portion extending from the inflatable instrument, and a rear anchor strap portion extending from a rear strap.

In yet another embodiment, the adjustable strap mechanism is connected to the inflatable instrument by a lobster clasp 132.

It should be noted that the inflatable instrument of the present invention as described above may be a double end bag, slip ball, and any bag or ball intended for use during a workout such as a boxing, kickboxing, or a martial arts workout.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed across multiple locations.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. An inflatable device, comprising:

a carcass defining a surface of the device and surrounding an inner volume of the device, and having an opening; and an internal air intake mechanism assembly, which comprises a primary one way valve mechanism joined to the carcass to cover the opening, the primary one way valve mechanism extending into the inner volume and being configured for enabling air to be directed into the inner volume from an environment external to the carcass, while preventing or limiting air flow from the inner volume to the external environment;

wherein the carcass includes a tube extending into the inner volume, the tube having an inner opening within the inner volume and an outer opening corresponding to the opening of the carcass, such that the inner volume is in fluid communication with the external environment via the tube;

wherein the primary one way valve mechanism is located within the tube, is sealingly joined to an inner surface of the tube, and is configured for enabling air to be directed into the inner volume from an environment external to the carcass via the tube, while preventing or limiting air flow from the inner volume to the external environment via the tube;

wherein the primary valve mechanism is recessed within the tube, leaving a hollow space between the outer opening of the tube and an edge of the primary one way valve mechanism;

wherein the air intake mechanism assembly comprises a retractable mechanism located in the hollow space between the outer opening of the tube and the edge of the primary one way valve mechanism, the retractable mechanism being a channel having two openings and being slidable along the inner surface of the tube, to protrude into the external environment from the tube's outer opening;

at least one adjustable strap mechanism comprising:

a strap member, wherein the strap member is an elongated closed loop of substantially inelastic material; and at least one D-ring attached to the strap member through the closed loop of the strap member.

2. The inflatable device of claim 1, wherein the adjustable strap mechanism is removably joined to the inflatable device.

3. The inflatable device of claim 1, wherein the adjustable strap mechanism is securely joined to the inflatable device.

4. The inflatable device of claim 1, wherein the at least one adjustable strap mechanism further comprises a swivel bearing mechanism, the swivel bearing mechanism comprising a spindle end attached to a D-ring and at least one end comprising a lobster clasp.

5. The inflatable device of claim 1, wherein the adjustable strap mechanism comprises a lobster clasp on at least one end.

6. The inflatable device of claim 2, wherein the at least one adjustable strap mechanism further comprises:

a front anchor strap portion extending from the inflatable device, and a rear anchor strap portion extending from a rear strap.

7. The inflatable device of claim 4, wherein the strap member forms a first end and a second end, one of the first end and the second end forming an attachment section.

8. The inflatable device of claim 4, wherein the strap member is attached to the inflatable device by a loop of elastic material.

9. The inflatable device of claim 4, wherein the strap member is attached to the inflatable device by a loop of non-elastic material.

10. The inflatable device of claim 4, wherein the strap member includes printed characters.

11. The inflatable device of claim 1, wherein the air intake mechanism assembly further comprises a sleeve configured to attach to a surface of the tube.

12. The inflatable device of claim 10, further comprising a cap, the cap configured to attach to the opening of the carcass.

13. The inflatable device of claim 1, further comprising a cap, the cap configured to attach to the retractable mechanism.

14. The inflatable device of claim 1, wherein the at least one adjustable strap mechanism does not have a swivel bearing mechanism.

* * * * *